US008883700B2

(12) United States Patent
Perez-Prat Vineusa et al.

(10) Patent No.: US 8,883,700 B2
(45) Date of Patent: Nov. 11, 2014

(54) DISHWASHING METHOD UTILIZING A CATIONIC POLYMER/SURFACTANT-FORMED COACERVATE

(75) Inventors: Eva Maria Perez-Prat Vineusa, Brussels (BE); Nathan Ray Whitely, Liberty, OH (US); Anna Asmanidou, Kampenhout (BE); Qing Chen, Beijing (CN); Robby Renilde François Keuleers, Lippelo (BE); An Van Laere, Zomergem (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 13/410,338

(22) Filed: Mar. 2, 2012

(65) Prior Publication Data

US 2012/0225802 A1 Sep. 6, 2012

(30) Foreign Application Priority Data

Mar. 3, 2011 (CN) ..... 2011 0 00342

(51) Int. Cl.

| | |
|---|---|
| ***C11D 1/62*** | (2006.01) |
| ***C11D 1/86*** | (2006.01) |
| ***C11D 11/00*** | (2006.01) |
| ***C11D 1/65*** | (2006.01) |
| ***C11D 1/835*** | (2006.01) |
| ***C11D 3/37*** | (2006.01) |

(52) U.S. Cl.

CPC ..... *C11D 1/65* (2013.01); *C11D 11/0023* (2013.01); *C11D 1/835* (2013.01); *C11D 3/3723* (2013.01)

USPC ..... 510/237; 510/235; 510/426; 510/427; 510/504

(58) Field of Classification Search

USPC ..... 510/235, 237, 426, 427, 504

See application file for complete search history.

(56) References Cited

U.S. PATENT DOCUMENTS

| | | | | |
|---|---|---|---|---|
| 4,101,456 | A * | 7/1978 | Renaud et al. | 510/429 |
| 4,368,146 | A * | 1/1983 | Aronson et al. | 134/25.2 |
| 6,008,181 | A | 12/1999 | Cripe et al. | |
| 6,020,303 | A | 2/2000 | Cripe et al. | |
| 6,060,443 | A | 5/2000 | Cripe et al. | |
| 6,274,540 | B1 | 8/2001 | Scheibel et al. | |
| 6,514,926 | B1 | 2/2003 | Kott et al. | |
| 6,525,233 | B1 | 2/2003 | Connor et al. | |
| 6,566,319 | B1 | 5/2003 | Scheibel et al. | |
| 6,593,285 | B1 | 7/2003 | Scheibel et al. | |
| 6,602,840 | B1 | 8/2003 | Scheibel et al. | |
| 6,908,894 | B2 | 6/2005 | Kott et al. | |
| 2006/0035807 | A1 * | 2/2006 | Kasturi et al. | 510/475 |
| 2007/0241306 | A1 * | 10/2007 | Wehner et al. | 252/67 |
| 2007/0275868 | A1 | 11/2007 | Cooremans et al. | |
| 2009/0068124 | A1 | 3/2009 | Beumer et al. | |
| 2009/0124525 | A1 * | 5/2009 | Futterer et al. | 510/180 |
| 2009/0176935 | A1 | 7/2009 | Boeckh et al. | |
| 2009/0298735 | A1 | 12/2009 | Boeckh et al. | |
| 2010/0197551 | A1 * | 8/2010 | Bettiol et al. | 510/236 |
| 2010/0197553 | A1 * | 8/2010 | Barnabas et al. | 510/236 |
| 2010/0197554 | A1 * | 8/2010 | Koyuncu et al. | 510/236 |
| 2012/0028872 | A1 * | 2/2012 | Perez-Prat Vinuesa et al. | 510/236 |

FOREIGN PATENT DOCUMENTS

| | | | |
|---|---|---|---|
| EP | 2 216 392 | A1 | 11/2010 |
| GB | 1 553 202 | A | 9/1979 |
| WO | WO-97/44423 | A1 | 11/1997 |
| WO | WO-98/16538 | A1 | 4/1998 |
| WO | WO-99/05084 | A1 | 2/1999 |
| WO | WO-99/24535 | A1 | 5/1999 |
| WO | WO-2007/028571 | A1 | 3/2007 |
| WO | WO 2010/088165 | A1 | 8/2010 |

OTHER PUBLICATIONS

International Search Report; International Application No. PCT/CN2011/000342; Date of mailing Jun. 19, 2013; 4 pages.

* cited by examiner

*Primary Examiner* — Charles Boyer

(74) *Attorney, Agent, or Firm* — David M. Weirich; Steven W. Miller

(57) ABSTRACT

The present invention relates to a method of manually cleaning dishware using a liquid hand dishwashing detergent composition comprising an anionic surfactant and a cationic polymer having a MW below or equal to 2,100,000; and a charge density above or equal to 0.45 meq/g, wherein such composition will have a coacervation index upon dilution of at least 2.5%; to provide skin care.

12 Claims, No Drawings

DISHWASHING METHOD UTILIZING A CATIONIC POLYMER/SURFACTANT-FORMED COACERVATE

FIELD OF INVENTION

The present invention relates to a method of manually cleaning dishware using a liquid hand dishwashing detergent composition comprising an anionic surfactant and a cationic polymer having a MW below or equal to 2,100,000; and a charge density above or equal to 0.45 meq/g, wherein such composition will have a coacervation index upon dilution of at least 2.5%. The present invention further relates to a method of preventing skin damage and improving the overall look and feel of the skin, in the context of a manual dishwashing operation.

BACKGROUND OF THE INVENTION

During the manual dishwashing process, the hands of users are exposed to dishwashing detergents containing surfactants and other components which cause a loss of skin hydration and/or cause skin irritation. Consequently, many users experience skin irritation and dryness following the washing-up process, and often users feel the need to apply a soothing or moisturizing product in order to restore moisturization.

One approach has been to formulate detergent compositions comprising surfactants which are milder on skin. Incorporation of skin protecting ingredients into light duty liquid detergents is also known in the art, for example WO99/24535, WO97/44423 and JP 2005-179438. Other approaches have involved incorporation of active ingredients with a beneficial effect on skin sensation into detergent compositions, i.e. WO 07/028,571. However, given the dilute conditions often associated with dishwashing, the skin protecting ingredients do not always successfully deposit on the skin. They do not therefore provide the sought skin care benefit, unless used at very high levels which can compromise the high suds profile and/or cleaning performance required for manual dish washing detergents. This results in very expensive formulations. It raises as well processability limitations such as raw material and finished product rheology control and raw material incorporation in the product at desired active level within dosing limits. Therefore, there remains an unmet need for a liquid hand dishwashing composition that is mild and hydrates and/or conditions the skin in a more cost efficient way, and that is easy to process.

It has been surprisingly found that liquid hand dishwashing compositions comprising an anionic surfactant and a cationic polymer having a MW below or equal to 2100000, and a charge density above or equal to 0.45 meq/g, wherein such composition will have a coacervation index upon dilution of at least 2.5%; will provide highly efficient skin conditioning during the hand dishwashing process while maintaining the required cleaning and sudsing properties of the composition in a very cost effective manner and with an improved manufacturing processability. Such efficient and cost effective skin care benefit, is even achieved under the dilute conditions associated with manual dish washing, and in the absence of further additional skin care technologies.

SUMMARY OF THE INVENTION

In a first embodiment, the present invention relates to a method of manually cleaning dishware using a liquid hand dishwashing detergent composition comprising an anionic surfactant and a cationic polymer having a MW below or equal to 2,100,000; and a charge density above or equal to 0.45 meq/g, wherein such composition will have a coacervation index upon dilution of at least 2.5%.

In a second embodiment, the present invention relates to a method of delivering a skin moisturization, skin feel and skin look benefit, more specifically to the hands' skin with such composition, during the process of cleaning dishware.

DETAILED DESCRIPTION OF THE INVENTION

As used herein "grease" means materials comprising at least in part (i.e. at least 0.5% by weight of the grease) saturated and unsaturated fats and oils, preferably oils and fats derived from animal sources such as beef and/or chicken.

As used herein "dishware" means a surface such as dishes, glasses, pots, pans, baking dishes and flatware made from ceramic, china, metal, glass, plastic (polyethylene, polypropylene, polystyrene, etc.) and wood.

As used herein "liquid hand dishwashing detergent composition" refers to those compositions that are employed in manual (i.e. hand) dishwashing. Such compositions are generally high sudsing or foaming in nature.

As used herein "cleaning" means applying to a surface for the purpose of cleaning, and/or disinfecting.

As used herein, "skin benefit" means the maintenance of or increase in skin hydration and/or skin moisturization levels and/or skin conditioning, and the positive impact to the skin feel and look of hands. As used herein "moisturization" means optimization of the water level in the skin through, improving the skin barrier to minimize evaporation of water from the skin.

As used herein "suds profile" means the amount of sudsing (high or low) and the persistence of sudsing (sustained sudsing) throughout the washing process resulting from the use of the liquid detergent composition of the present invention. As used herein "high sudsing" refers to liquid hand dishwashing detergent compositions which are both high sudsing (i.e. a level of sudsing considered acceptable to the consumer) and have sustained sudsing (i.e. a high level of sudsing maintained throughout the dishwashing operation). This is particularly important with respect to liquid dishwashing detergent compositions as the consumer uses high sudsing as an indicator of the performance of the detergent composition. Moreover, the consumer of a liquid dishwashing detergent composition also uses the sudsing profile as an indicator that the wash solution still contains active detergent ingredients. The consumer usually renews the wash solution when the sudsing subsides. Thus, a low sudsing liquid dishwashing detergent composition formulation will tend to be replaced by the consumer more frequently than is necessary because of the low sudsing level.

The Process of Cleaning/Treating a Dishware

The method of the present invention surprisingly provides improved and cost effective skin care benefits, especially sensory benefits such as skin moisturization, smoothness, softness, suppleness, and improved skin appearance, while maintaining adequate dishware cleaning performance and sudsing profile and the necessary product stability and processability.

The present invention is directed to a process of cleaning a dishware with a liquid composition comprising an anionic surfactant and a cationic polymer having a MW below or equal to 2,100,000; and a charge density above or equal to 0.45 meq/g, wherein such composition will have a coacervation index upon dilution of at least 2.5%. Said process comprises the step of applying said composition onto the dishware surface, typically in diluted or neat form and rinsing or leaving said composition to dry on said surface without rinsing said surface.

By "in its neat form", it is meant herein that said liquid composition is applied directly onto the surface to be treated and/or onto a cleaning device or implement such as a dish cloth, a sponge or a dish brush without undergoing any dilution at 0 gpg water hardness by the user (immediately) prior to the application. By "diluted form", it is meant herein that said liquid composition is diluted by the user with an appropriate solvent, typically water. By "rinsing", it is meant herein contacting the dishware cleaned with the process according to the present invention with substantial quantities of appropriate solvent, typically water, after the step of applying the liquid composition herein onto said dishware. By "substantial quantities", it is meant usually about 5 to about 20 liters.

In one embodiment of the present invention, the composition herein can be applied in its diluted form. Soiled dishes are contacted with an effective amount, typically from about 0.5 ml to about 20 ml (per about 25 dishes being treated), preferably from about 3 ml to about 10 ml, of the liquid detergent composition of the present invention diluted in water. The actual amount of liquid detergent composition used will be based on the judgment of user, and will typically depend upon factors such as the particular product formulation of the composition, including the concentration of active ingredients in the composition, the number of soiled dishes to be cleaned, the degree of soiling on the dishes, and the like. Generally, from about 0.01 ml to about 150 ml, preferably from about 3 ml to about 40 ml of a liquid detergent composition of the invention is combined with from about 2000 ml to about 20000 ml, more typically from about 5000 ml to about 15000 ml of water in a sink having a volumetric capacity in the range of from about 1000 ml to about 20000 ml, more typically from about 5000 ml to about 15000 ml. The soiled dishes are immersed in the sink containing the diluted compositions then obtained, where contacting the soiled surface of the dish with a cloth, sponge, or similar article cleans them. The cloth, sponge, or similar article may be immersed in the detergent composition and water mixture prior to being contacted with the dish surface, and is typically contacted with the dish surface for a period of time ranged from about 1 to about 10 seconds, although the actual time will vary with each application and user. The contacting of cloth, sponge, or similar article to the dish surface is preferably accompanied by a concurrent scrubbing of the dish surface.

Another method of the present invention will comprise immersing the soiled dishes into a water bath or held under running water without any liquid dishwashing detergent. A device for absorbing liquid dishwashing detergent, such as a sponge, is placed directly into a separate quantity of undiluted liquid dishwashing composition for a period of time typically ranging from about 1 to about 5 seconds. The absorbing device, and consequently the undiluted liquid dishwashing composition, is then contacted individually to the surface of each of the soiled dishes to remove said soiling. The absorbing device is typically contacted with each dish surface for a period of time range from about 1 to about 10 seconds, although the actual time of application will be dependent upon factors such as the degree of soiling of the dish. The contacting of the absorbing device to the dish surface is preferably accompanied by concurrent scrubbing.

Alternatively, the device may be immersed in a mixture of the hand dishwashing composition and water prior to being contacted with the dish surface, said concentrated solution is made by diluting the hand dishwashing composition with water in a small container that can accommodate the cleaning device at ratios ranging from about 95:5 to about 5:95, preferably about 80:20 to about 20:80 and more preferably about 70:30 to about 30:70 of hand dishwashing liquid:water respectively depending upon the user habits and the cleaning task.

Dependent on the geography of use of the composition, the water used in the method of the present invention can have a hardness level of about 0-30 gpg ("gpg" is a measure of water hardness that is well known to those skilled in the art, and it stands for "grains per gallon").

Method of Moisturizing Skin

In another embodiment this invention relates to use of a liquid hand dishwashing detergent composition to deliver a positive skin care benefit, more specifically a positive skin feel benefit, and an improvement of skin appearance, especially to the skin of hands, during a manual dishwashing operation. This operation consists of the step of contacting the skin of the person carrying out the dishwashing operation with the composition of the present invention. The liquid hand dishwashing composition of this method may be in its neat form, or in a diluted or concentrated premix form as outlined in the 'process of cleaning/treating a dishware' described herein.

The Liquid Composition

The liquid hand dishwashing compositions herein typically contain from 30% to 95%, preferably from 40% to 80%, more preferably from 50% to 75% by weight of an aqueous liquid carrier in which the other essential and optional compositions components are dissolved, dispersed or suspended. One preferred component of the aqueous liquid carrier is water.

The liquid hand dishwashing compositions herein may have any suitable pH. Preferably the pH of the composition is adjusted to between 3 and 14, more preferably between 6 and 13, most preferably between 8 and 10. The pH of the composition can be adjusted using pH modifying ingredients known in the art.

The liquid hand dishwashing compositions herein are preferably thickened and have preferably a viscosity from 50 to 3000 centipoises (50-3000 mPa*s), more preferably from 100 to 2500 centipoises (100-2500 mPa*s), and most preferably from 500 to 2000 centipoises (500-2000 mPa*s) at 20 s-1 and 20° C. Viscosity can be determined by conventional methods, e.g. using an AR 550 rheometer from TA instruments using a plate steel spindle at 40 mm diameter and a gap size of 500 μm. The high shear viscosity at 20 s-1 and low shear viscosity at 0.05 s-1 can be obtained from a logarithmic shear rate sweep from 0.1 s-1 to 25 s-1 in 3 minutes time at 20° C. The preferred rheology described therein may be achieved using internal existing structuring with detergent ingredients or by employing an external rheology modifier.

The Cationic Polymer

The liquid hand dishwashing compositions herein comprise at least one cationic polymer having a MW below or equal to 2,100,000 and a charge density above or equal to 0.45 meq/g. The cationic polymer will typically be present a level of from 0.001 wt % to 10 wt %, preferably from 0.01 wt % to 5 wt %, more preferably from 0.05% to 1% by weight of the total composition.

The average molecular weight (MW) of the cationic polymer is preferably between 5,000 to 2,100,000; preferably between 15,000 and 1,000,000; more preferably between 50,000 and 600,000, even more preferably between 350,000 and 500,000. It has been found that higher MW should be avoided to avoid undesirable high rheology profiles hence limiting processibility of aqueous polymer solutions, to avoid active build-up on dishware, and to avoid phase stability stress in finished product formulations.

The polymers are further characterised by a target cationic charge density above or equal to 0.45 meq/g, preferably from 0.45 to 5 meq/g, more preferably from 0.45 to 2.3 meq/g, even more preferably from 0.45 to 1.5 meq/g. It has been found indeed that such charge density is required for the formation of proper coacervates, the deposition on the skin and therefore for the required skin benefit.

As used herein the "charge density" of the cationic polymers is defined as the number of cationic sites per polymer gram atomic weight (molecular weight), and can be expressed in terms of meq/gram of cationic charge. Charge density values should be read as the maximum intrinsic charge density the polymer of consideration will have, i.e. under the condition of maximum protonation. Any anionic counterions can be used in association with cationic polymers, so long as the polymer remains soluble in water and in the liquid hand dishwashing matrix, and so long that the counterion is physically and chemically stable with the essential components of this liquid hand dishwashing liquid, or do not unduly impair product performance, stability nor aesthetics. Non-limiting examples of such counterions include halides (e.g. chlorine, fluorine, bromine, iodine), sulphate and methylsulfate.

Suitable cationic polymers for use in current invention contain cationic nitrogen containing moieties such as quaternary ammonium or cationic protonated amino moieties.

Specific examples of the water soluble cationized polymer include cationic polysaccharides such as cationized cellulose derivatives, cationized starch and cationized guar gum derivatives. Also included are synthetically derived copolymers such as homopolymers of diallyl quaternary ammonium salts, diallyl quaternary ammonium salt/acrylamide copolymers, quaternized polyvinylpyrrolidone derivatives, polyglycol polyamine condensates, vinylimidazolium trichloride/vinylpyrrolidone copolymers, dimethyldiallylammonium chloride copolymers, vinylpyrrolidone/quaternized dimethylaminoethyl methacrylate copolymers, polyvinylpyrrolidone/alkylamino acrylate copolymers, polyvinylpyrrolidone/alkylamino acrylate/vinylcaprolactam copolymers, vinylpyrrolidone/methacrylamidopropyl trimethylammonium chloride copolymers, alkylacrylamide/acrylate/alkylaminoalkylacrylamide/polyethylene glycol methacrylate copolymers, adipic acid/dimethylaminohydroxypropyl ethylenetriamine copolymer ("Cartaretin"—product of Sandoz/USA), and optionally quaternized/protonated condensation polymers having at least one heterocyclic end group connected to the polymer backbone through a unit derived from an alkylamide, the connection comprising an optionally substituted ethylene group (as described in WO 2007 098889, pages 2-19)

Specific commercial but non-limiting examples of the above described water soluble cationized polymers are "Merquat 550" (a copolymer of acrylamide and diallyl dimethyl ammonium salt—CTFA name: Polyquatemium-7, product of ONDEO-NALCO); "Gafquat 755N" (a copolymer of 1-vinyl-2-pyrrolidone and dimethylaminoethyl methacrylate—CTFA name: Polyquatemium-11, product ex ISP); "Polymer KG, "Polymer JR series" and "Polymer LR series" (salt of a reaction product between trimethyl ammonium substituted epoxide and hydroxyethyl cellulose—CTFA name: Polyquatemium-10, product of Amerchol); "SoftCat" polymer series (quaternized hydroxyethyl cellulose derivatives with cationic substitution of trimethyl ammonium and dimethyl dodecyl ammonium—CTFA name: Polyquaternium 67, product of Amerchol); and "Jaguar series" ex. Rhodia, "N-hance" series, and AquaCat "series" ex. Aqualon (guar hydroxypropyltrimonium chloride, and hydroxypropylguar hydroxypropyltrimonium chloride)

Preferred cationic polymers are cationic polysaccharides, more preferably are cationic cellulose derivatives and/or cationic guar gums derivatives; even more preferably are cationic guar gums derivatives. Cationic cellulose derivatives are e.g. the salts of hydroxyethyl cellulose reacted with trimethyl ammonium substituted epoxide, referred to in the industry (CTFA) as Polyquaternium-10, such as UCARE JR30M, and Ucare KG30M, ex. Dow Amerchol. Cationic guar gum derivatives are guar hydroxypropyltrimonium chloride, such as the Jaguar® series ex Rhodia, N-Hance® and AquaCat® polymer series available from Aqualon, specific commercial non-limiting examples of which are Jaguar® C-500, N-Hance® 3270, N-Hance® 3196, and AquaCat® CG518.

Anionic Surfactant

The composition of the present invention will comprise an anionic surfactant typically at a level of 4% to 40%, preferably 6% to 32%, more preferably 11% to 25% weight of the total composition. In a preferred embodiment the composition has no more than 15%, preferably no more than 10%, more preferably no more than 5% by weight of the total composition, of a sulfonate surfactant.

Suitable anionic surfactants to be used in the compositions and methods of the present invention are sulfate, sulfonate, sulfosuccinates and/or sulfoacetate; preferably alkyl sulfate and/or alkyl ethoxy sulfates; more preferably a combination of alkyl sulfates and/or alkyl ethoxy sulfates with a combined ethoxylation degree less than 5, preferably less than 3, more preferably less than 2.

Sulphate Surfactants

Suitable sulphate surfactants include water-soluble salts or acids of $C_{10}$-$C_{14}$ alkyl or hydroxyalkyl, sulphate and/or ether sulfate. Suitable counterions include hydrogen, alkali metal cation or ammonium or substituted ammonium, but preferably sodium.

Where the hydrocarbyl chain is branched, it preferably comprises $C_{1-4}$ alkyl branching units. The average percentage branching of the sulphate surfactant is preferably greater than 30%, more preferably from 35% to 80% and most preferably from 40% to 60% of the total hydrocarbyl chains.

The sulphate surfactants may be selected from $C_8$-$C_{20}$ primary, branched-chain and random alkyl sulphates (AS); $C_{10}$-$C_{18}$ secondary (2,3) alkyl sulphates; $C_{10}$-$C_{18}$ alkyl alkoxy sulphates ($AE_xS$) wherein preferably x is from 1-30; $C_{10}$-$C_{18}$ alkyl alkoxy carboxylates preferably comprising 1-5 ethoxy units; mid-chain branched alkyl sulphates as discussed in U.S. Pat. No. 6,020,303 and U.S. Pat. No. 6,060,443; mid-chain branched alkyl alkoxy sulphates as discussed in U.S. Pat. No. 6,008,181 and U.S. Pat. No. 6,020,303.

Alkyl Sulfosuccinates—Sulfoacetate

Other suitable anionic surfactants are alkyl, preferably dialkyl, sulfosuccinates and/or sulfoacetate. The dialkyl sulfosuccinates may be a $C_{6-15}$ linear or branched dialkyl sulfosuccinate. The alkyl moieties may be asymmetrical (i.e., different alkyl moiety.es) or preferably symmetrical (i.e., the same alkyl moieties).

Sulphonate Surfactants

The compositions of the present invention will preferably comprise no more than 15% by weight, preferably no more than 10%, even more preferably no more than 5% by weight of the total composition, of a sulphonate surfactant. Those include water-soluble salts or acids of $C_{10}$-$C_{14}$ alkyl or hydroxyalkyl, sulphonates; $C_{11}$-$C_{18}$ alkyl benzene sulphonates (LAS), modified alkylbenzene sulphonate (MLAS) as discussed in WO 99/05243, WO 99/05242, WO 99/05244, WO 99/05082, WO 99/05084, WO 99/05241, WO 99/07656, WO 00/23549, and WO 00/23548; methyl ester sulphonate (MES); and alpha-olefin sulphonate (AOS). Those also include the paraffin sulphonates may be monosulphonates and/or disulphonates, obtained by sulphonating paraffins of 10 to 20 carbon atoms. The sulfonate surfactant also include the alkyl glyceryl sulphonate surfactants.

The Coacervation System

The composition of the present invention will demonstrate a coacervation index upon dilution with deionized water (0 gpg water hardness) above or equal to 2.5%, preferably above or equal to 3.5%, more preferably above or equal to 6%.

The association between anionic surfactants and cationic polymers driven by both electrostatic and hydrophobic interactions results in a liquid-liquid phase separation where a polymer-rich phase, typically in the form of a gel or thickened phase, separates from a polymer devoid phase. This phenomenon, is known as coacervation, and the polymer-surfactant gel like aggregates are known as coacervates. It has been found that coacervation enhances the skin deposition of skin care actives, especially of the cationic polymers. Without whishing to be bound by theory, it is believed that when coacervates are formed, the deposition of the cationic polymer is less dependent on the intrinsic affinity of said polymer for the skin surface. Coacervates are believed to provide skin conditioning benefits, especially under diluted usage conditions during the cleaning or the rinsing steps. Indeed, it is believed that the deposited cationic polymer forms a film on the skin surface that can mitigate the irritancy potential of surfactants, reducing skin irritation and the skin-stiffening effect of detergents, and increasing skin pH buffering capacity. Furthermore, the polymer barrier thus formed contributes to enhance skin hydration levels by preventing water loss (evaporation) from the skin. The combination of these benefits results in an improvement of skin condition, feel and appearance.

A further advantage of this invention is that the skin care benefit can be delivered in a very efficient manner under the conditions typically found with the various methods of washing dishes used by consumers, i.e. from neat application to more diluted conditions. The liquid hand dishwashing detergent composition of the present invention can be used to provide a method of moisturizing and conditioning the skin in the context of a manual dish washing operation.

As used herein "coacervation index" means the % of coacervate formed by the composition when diluted with deionized water (0 gpg water hardness) to obtain a 5% wt solution of said composition (i.e. 5 g of the composition in 100 g of total solution made with deionized water). Coacervation index or % coacervate is calculated according to the following equation:

$$\text{Coacervation Index} = \%\ \text{coacervate} = (\text{isolated coacervate(g)})/(\text{amount of hand dish composition used (g)}) \times 100$$

wherein the term "coacervate" refers to the aggregate formed by the interaction between the anionic surfactant and the cationic polymer of the present composition upon dilution of said composition with deionized water.

Coacervation Index Method:

To measure coacervation index of the composition of the present invention, dilutions of said composition are prepared at ambient temperature (20° C.) by adding a given amount (g) of the composition into a clean 50 mL conical transparent centrifuge tube (the weight of which is recorded as the empty tube tare weight) followed by deionized water to achieve the desired 5% product dilution ratio by weight. For example 2.5 g of the composition and 47.5 g of deionized water are added to obtain 50 g total weight of a 5% solution by weight of said composition (1:20 dilution). The centrifuge tube is placed on a tube rotator (e.g. CEL-GROT™ Tissue culture rotator) set at medium rotation speed and left to mix overnight at ambient temperature (20° C.). The centrifuge tube is centrifuged at 4500 rpm for 60 minutes at ambient temperature using a Beckman-Coulter centrifuge model Allegra X22R equipped with a SX4250 swinging bucket rotor, so that the coacervate settles to the bottom of the centrifuge tube. The supernatant overlaying the coacervate at the top of the centrifuge tube is decanted without disturbing and/or pouring any coacervate from the tube. If the coacervate is fluid, decanting may comprise pipetting or other means to remove the supernatant without touching or disturbing in any way the coacervate phase at the bottom of the centrifuge tube. Traces of supernatant are dried from the interior walls of the centrifuge tube using absorbent paper without touching the coacervate. The centrifuge tube is then weighed to determine weight of the coacervate (g) by subtracting the empty tube tare weight.

Preferred compositions for use in the method of the present invention will demonstrate a coacervation index upon dilution that is not substantially impacted by the water hardness of the water used to make the product dilution. By "substantially not impacted", it is meant herein that the coarcervation index of the composition will be maintained at a value equal or above to 6%. Therefore such compositions could deliver the desired skin conditioning benefit independently of the water hardness of the geography of use. Hence, preferred cationic polymers of the present invention can be further selected by measuring the coacervation index of the corresponding composition upon dilution with water of higher water hardness e.g. 15 gpg.

Furthermore, it has been found that coacervates demonstrating a viscoelastic behavior are preferred. Without wishing to be bound by theory; it is believed that the viscoelastic properties increase the adhesion of coacervate to skin resulting in enhanced deposition. Therefore, the cationic polymers able to form coacervates with optimized viscoelastic properties in an anionic surfactant containing detergent composition, are further preferred. By viscoelastic properties it is meant the combination of fluid-like properties (viscous) as well as solid-like characteristics (elastic). Viscoelastic properties are commonly measured by elastic or storage modulus (G') and viscous or loss modulus (G") using methods such as stress sweep, frequency sweep, and/or dynamic recovery test.

Further Surfactant

The compositions can comprise further a surfactant selected from nonionic, cationic, amphoteric, zwitterionic, semi-polar nonionic surfactants, and mixtures thereof. In a further preferred embodiment, the composition of the present invention will further comprise amphoteric and/or zwitterionic surfactant, more preferably an amine oxide or betaine surfactant.

The most preferred surfactant system for the compositions of the present invention will therefore comprise: (i) 4% to 40%, preferably 6% to 32%, more preferably 11% to 25% weight of the total composition of an anionic surfactant (2) combined with 0.01% to 20% wt, preferably from 0.2% to 15% wt, more preferably from 0.5% to 10% by weight of the liquid detergent composition amphoteric and/or zwitterionic surfactant, more preferably an amphoteric and even more preferred an amine oxide surfactant. It has been found that such surfactant system will provide the excellent cleaning required from a hand dishwashing liquid composition while being very soft and gentle to the hands.

The total level of surfactants is usually from 1.0% to 50% wt, preferably from 5% to 40% wt, more preferably from 8% to 35% by weight of the liquid detergent composition. Non-limiting examples of optional surfactants are discussed below.

Amphoteric and Zwitterionic Surfactants

The amphoteric and zwitterionic surfactant can be comprised at a level of from 0.01% to 20%, preferably from 0.2% to 15%, more preferably 0.5% to 10% by weight of the liquid detergent composition. Suitable amphoteric and zwitterionic surfactants, are amine oxides and betaines.

Most preferred are amine oxides, especially coco dimethyl amine oxide or coco amido propyl dimethyl amine oxide. Amine oxide may have a linear or mid-branched alkyl moiety. Typical linear amine oxides include water-soluble amine oxides containing one R1 $C_{8-18}$ alkyl moiety and 2 R2 and $R_3$ moieties selected from the group consisting of $C_{1-3}$ alkyl groups and $C_{1-3}$ hydroxyalkyl groups. Preferably amine oxide is characterized by the formula $R_1$—$N(R_2)(R_3)$—O wherein $R_1$ is a $C_{8-18}$ alkyl and $R_2$ and $R_3$ are selected from the group consisting of methyl, ethyl, propyl, isopropyl, 2-hydroxethyl, 2-hydroxypropyl and 3-hydroxypropyl. The linear amine oxide surfactants in particular may include linear $C_{10}$-$C_{18}$ alkyl dimethyl amine oxides and linear $C_8$-$C_{12}$ alkoxy ethyl dihydroxy ethyl amine oxides. Preferred amine oxides include linear $C_{10}$, linear $C_{10}$-$C_{12}$, and linear $C_{12}$-$C_{14}$ alkyl dimethyl amine oxides. As used herein "mid-branched" means that the amine oxide has one alkyl moiety having $n_1$ carbon atoms with one alkyl branch on the alkyl moiety having $n_2$ carbon atoms. The alkyl branch is located on the α carbon from the nitrogen on the alkyl moiety. This type of branching for the amine oxide is also known in the art as an internal amine oxide. The total sum of $n_1$ and $n_2$ is from 10 to 24 carbon atoms, preferably from 12 to 20, and more preferably from 10 to 16. The number of carbon atoms for the one alkyl moiety ($n_1$) should be approximately the same number of carbon atoms as the one alkyl branch ($n_2$) such that the one alkyl moiety and the one alkyl branch are symmetric. As used herein "symmetric" means that $|n_1-n_2|$ is less than or equal to 5, preferably 4, most preferably from 0 to 4 carbon atoms in at least 50 wt %, more preferably at least 75 wt % to 100 wt % of the mid-branched amine oxides for use herein.

The amine oxide further comprises two moieties, independently selected from a $C_{1-3}$ alkyl, a $C_{1-3}$ hydroxyalkyl group, or a polyethylene oxide group containing an average of from about 1 to about 3 ethylene oxide groups. Preferably the two moieties are selected from a $C_{1-3}$ alkyl, more preferably both are selected as a $C_1$ alkyl.

Other suitable surfactants include betaines such alkyl betaines, alkylamidobetaine, amidazoliniumbetaine, sulfobetaine (INCI Sultaines) as well as the Phosphobetaine and preferably meets formula I:

$$R^1—[CO—X(CH_2)_n]_x—N^+(R^2)(R_3)—(CH_2)_m—[CH(OH)—CH_2]_y—Y— \quad \text{(I) wherein}$$

$R^1$ is a saturated or unsaturated C6-22 alkyl residue, preferably C8-18 alkyl residue, in particular a saturated C10-16 alkyl residue, for example a saturated C12-14 alkyl residue;

X is NH, $NR^4$ with C1-4 Alkyl residue $R^4$, O or S, n a number from 1 to 10, preferably 2 to 5, in particular 3, x 0 or 1, preferably 1, $R^2$, $R^3$ are independently a $C_{1-4}$ alkyl residue, potentially hydroxy substituted such as a hydroxyethyl, preferably a methyl.

m a number from 1 to 4, in particular 1, 2 or 3, y 0 or 1 and

Y is COO, SO3, $OPO(OR^5)O$ or $P(O)(OR^5)O$, whereby $R^5$ is a hydrogen atom H or a C1-4 alkyl residue.

Preferred betaines are the alkyl betaines of the formula (Ia), the alkyl amido betaine of the formula (Ib), the Sulfo betaines of the formula (Ic) and the Amido sulfobetaine of the formula (Id);

$$R^1—N^+(CH_3)_2—CH_2COO^- \quad \text{(Ia)}$$

$$R^1—CO—NH(CH_2)_3—N^+(CH_3)_2—CH_2COO^- \quad \text{(Ib)}$$

$$R^1—N^+(CH_3)_2—CH_2CH(OH)CH_2SO_3— \quad \text{(Ic)}$$

$$R^1—CO—NH—(CH_2)_3—N^+(CH_3)_2—CH_2CH(OH)CH_2SO_3— \quad \text{(Id)}$$

in which $R^1$ as the same meaning as in formula I. Particularly preferred betaines are the Carbobetaine [wherein Y═COO], in particular the Carbobetaine of the formula (Ia) and (Ib), more preferred are the Alkylamidobetaine of the formula (Ib). A preferred betaine is Cocoamidopropyl betaines.

Nonionic Surfactants

Nonionic surfactant, when present, is comprised in a typical amount of from 0.1% to 20%, preferably 0.5% to 10% by weight of the liquid detergent composition. Suitable nonionic surfactants include aliphatic alcohols and the condensation products of aliphatic alcohols with from 1 to 25 moles of ethylene oxide. The alkyl chain of the aliphatic alcohol can either be straight or branched, primary or secondary, and generally contains from 8 to 22 carbon atoms. Branched aliphatic alcohols also include guerbet alcohol based compounds. Particularly preferred are the condensation products of alcohols having an alkyl group containing from 10 to 18 carbon atoms, preferably from 10 to 15 carbon atoms with from 2 to 18 moles, preferably 2 to 15, more preferably 5-12 of ethylene oxide per mole of alcohol.

Also suitable are alkylpolyglycosides having the formula $R^2O(C_nH_{2n}O)_t(\text{glycosyl})_x$, (formula (III)), wherein $R^2$ of formula (III) is selected from the group consisting of alkyl, alkyl-phenyl, hydroxyalkyl, hydroxyalkylphenyl, and mixtures thereof in which the alkyl groups contain from 10 to 18, preferably from 12 to 14, carbon atoms; n of formula (III) is 2 or 3, preferably 2; t of formula (III) is from 0 to 10, preferably 0; and x of formula (III) is from 1.3 to 10, preferably from 1.3 to 3, most preferably from 1.3 to 2.7. The glycosyl is preferably derived from glucose. Also suitable are alkylglycerol ethers and sorbitan esters.

Also suitable are fatty acid amide surfactants such as the $C_8$-$C_{20}$ ammonia amides, monoethanolamides, diethanolamides, and isopropanolamides.

Cationics Surfactants

Cationic surfactants can also be formulated typically at 0.1% to 20%, by weight of composition. Suitable cationic surfactants are quaternary ammonium surfactants. Suitable quaternary ammonium surfactants are selected from the group consisting of mono $C_6$-$C_{16}$, preferably $C_6$-$C_{10}$ N-alkyl or alkenyl ammonium surfactants, wherein the remaining N positions are substituted by methyl, hydroxyehthyl or hydroxypropyl groups. Another preferred cationic surfactant is an $C_6$-$C_{18}$ alkyl or alkenyl ester of a quaternary ammonium alcohol, such as quaternary chlorine esters.

Rheology Modifier

The composition herein may further comprise as an optional ingredient a rheology modifier. The overall objective in adding such a rheology modifier to the compositions herein is to arrive at liquid compositions which are suitably functional and aesthetically pleasing from the standpoint of product thickness, product pourability, product optical properties, and/or particles suspension performance.

Generally the rheology modifier will be comprised at a level from 0.001% to 3% wt, preferably from 0.01% to 1% wt, more preferably from 0.02% to 0.8% by weight of the total composition. The rheology modifier is selected from non-polymeric crystalline, hydroxy-functional materials, and/or polymeric rheology modifiers which impart shear thinning characteristics to the aqueous liquid matrix of the composition. Specific examples of preferred crystalline, hydroxyl-containing rheology modifiers include castor oil and its derivatives. Especially preferred are hydrogenated castor oil derivatives such as hydrogenated castor oil and hydrogenated castor wax. Commercially available, castor oil-based, crystalline, hydroxyl-containing rheology modifiers include THIXCIN® from Rheox, Inc. (now Elementis). Suitable polymeric rheology modifiers include those of the polyacrylate, polysaccharide or polysaccharide derivative type. Polysaccharide derivatives typically used as rheology modifiers comprise polymeric gum materials. Such gums include pectine, alginate, arabinogalactan (gum Arabic), carrageenan, gellan gum, xanthan gum and guar gum and carboxymethyl cellulose. Commercial examples of these polymeric rheology modifiers include Gellan marketed by CP Kelco U.S., Inc. under the KELCOGEL tradename, especially preferred is Micro Fibril Cellulose (MFC) from CPKelko under Cellulon® tradename. A further alternative and suitable rheology modifier is a combination of a solvent and a polycarboxylate polymer. Preferred embodiment the rheology modifier is a polyacrylate of unsaturated mono- or di-carbonic acid and 1-30C alkyl ester of the (meth) acrylic acid. Such copolymers are available from Noveon Inc under the tradename Carbopol Aqua 30.

The Pearlescent Agent

The composition herein may comprise as an optional ingredient one or more pearlescent agents. Suitable agents are crystalline or glassy solids, transparent or translucent compounds capable of reflecting and refracting light to produce a pearlescent effect. Such can be either an organic and/or an inorganic pearlescent agent.

When the composition of the present invention comprises an organic pearlescent agent, it is comprised at an active level of from 0.05% to 2.0% wt, preferably from 0.1% to 1.0% w of the total composition of the 100% active organic pearlescent agents. Suitable organic pearlescent agents include monoester and/or diester of alkylene glycols. Typical examples are fatty monoesters and/or diesters of ethylene glycol, propylene glycol, diethylene glycol, dipropylene glycol, diethylene glycol or tetraethylene glycol. Example of fatty ester are commercially available such as PEG6000MS® is available from Stepan, Empilan EGDS/A® is available from Albright & Wilson or pre-crystallized organic pearlescent commercially available such as Stepan, Pearl-2 and Stepan Pearl 4 (produced by Stepan Company Northfield, Ill.), Mackpearl 202, Mackpearl 15-DS, Mackpearl DR-104, Mackpearl DR-106 (all produced by McIntyre Group, Chicago, Ill.), Euperlan PK900 Benz-W and Euperlan PK 3000 AM (produced by Cognis Corp).

When the composition of the present invention comprise an inorganic pearlescent agent, it is comprised at an active level of from 0.005% to 1.0% wt, preferably from 0.01% to 0.2% by weight of the composition of the 100% active inorganic pearlescent agents. Inorganic pearlescent agents include aluminosilicates and/or borosilicates. Preferred are the aluminosilicates and/or borosilicates which have been treated to have a very high refractive index, preferably silica, metal oxides, oxychloride coated aluminosilicate and/or borosilicates. More preferably inorganic pearlescent agent is mica, even more preferred titanium dioxide treated mica such as BASF Mearlin Superfine. Other commercially available suitable inorganic pearlescent agents are available from Merck under the tradenames Iriodin, Biron, Xirona, Timiron Colorona, Dichrona, Candurin and Ronastar. Other commercially available inorganic pearlescent agent are available from BASF (Engelhard, Mead) under tradenames Biju, Bi-Lite, Chroma-Lite, Pearl-Glo, Mearlite and from Eckart under the tradenames Prestige Soft Silver and Prestige Silk Silver Star.

Particle size (measured across the largest diameter of the sphere) of the pearlescent agent is typically below 200 microns, preferably below 100 microns, more preferably below 50 microns.

Enzymes

The composition of the present invention herein may optionally further comprise an enzyme, preferably a protease to provide additional hand mildness benefit.

Suitable proteases include those of animal, vegetable or microbial origin. Microbial origin is preferred. Chemically or genetically modified mutants are included. The protease may be a serine protease, preferably an alkaline microbial protease or a trypsin-like protease. Examples of neutral or alkaline proteases include:

(a) subtilisins (EC 3.4.21.62), especially those derived from *Bacillus*, such as *Bacillus lentus, B. alkalophilus, B. subtilis, B. amyloliquefaciens, Bacillus licheniformis, Bacillus pumilus* and *Bacillus gibsonii*, and *Cellumonas* described in U.S. Pat. No. 6,312,936 B1, U.S. Pat. No. 5,679,630, U.S. Pat. No. 4,760,025, U.S. Pat. No. 5,030,378, WO 05/052146, DEA6022216A1 and DEA 6022224A1.

(b) trypsin-like proteases are trypsin (e.g., of porcine or bovine origin) and the Fusaritun protease described in WO 89/06270.

(c) metalloproteases, especially those derived from *Bacillus amyloliquefaciens* described in WO 07/044,993A2.

Enzymes are typically incorporated into the composition at a level of from 0.00001% to 1%, preferably at a level of from 0.0001% to 0.5%, more preferably at a level of from 0.0001% to 0.1% of enzyme protein by weight of the total composition.

The Hydrophobic Emollient

The composition of the present invention herein may optionally further comprise one or more hydrophobic emollients which are agents that soften or soothe the skin by slowing the evaporation of water. Hydrophobic emollients form an oily layer on the surface of the skin that slows water loss increasing skin moisture content and skin water holding capacity. Hydrophobic emollients lubricate the skin and enhance skin barrier function improving skin elastidity and appearance.

Preferably, the liquid detergent composition used in the method according to the present invention comprises high levels of hydrophobic emollient, typically up to 10% by weight. The hydrophobic emollient is preferably present from 0.25% to 10%, more preferably from 0.3% to 8%, most preferably from 0.5% to 6% by weight of the total composition.

Hydrophobic emollients suitable for use in the compositions herein are hydrocarbon oils and waxes; silicones; fatty acid derivatives; glyceride esters, di and tri-glycerides, acetoglyceride esters; alkyl and alkenyl esters; cholesterol and cholesterol derivatives; vegetable oils, vegetable oil derivatives, liquid nondigestible oils, or blends of liquid digestible or nondigestible oils with solid polyol polyesters; natural waxes such as lanolin and its derivatives, beeswax and its derivatives, spermaceti, candelilla, and carnauba waxes; phospholipids such as lecithin and its derivatives; sphingolipids such as ceramide; and homologs thereof and mixtures thereof.

Examples of suitable Hydrocarbon Oils and Waxes include: petrolatum, mineral oil, micro-crystalline waxes, polyalkenes (e.g. hydrogenated and nonhydrogenated polybutene and polydecene), paratrins, cerasin, ozokerite, polyethylene and perhydrosqualene. Preferred hydrocarbon oils are petrolatum and/or blends of petrolatum and mineral oil.

Examples of suitable Silicone Oils include: dimethicone copolyol, dimethylpolysiloxane, diethylpolysiloxane, high molecular weight dimethicone, mixed $C_{1-30}$ alkyl polysiloxane, phenyl dimethicone, dimethiconol, and mixtures thereof. More preferred are non-volatile silicones selected from dimethicone, dimethiconol, mixed $C_{1-30}$alkyl polysiloxane, and mixtures thereof.

Examples of suitable glyceride esters include: castor oil, soy bean oil, derivatized soybean oils such as maleated soy bean oil, safflower oil, cotton seed oil, corn oil, walnut oil, peanut oil, olive oil, cod liver oil, almond oil, avocado oil, vegetable oils and vegetable oil derivatives; coconut oil and derivatized coconut oil, cottonseed oil and derivatized cottonseed oil, jojoba oil, cocoa butter, and the like. Preferred glyceride is castor oil.

Acetoglyceride esters may also be used, an example being acetylated monoglycerides.

Preferred hydrophobic emollients are petrolatum, mineral oil and/or blends of petrolatum and mineral oil; tri-glycerides such as the ones derived from vegetable oils; oily sugar derivatives; beeswax; lanolin and its derivatives including but not restricted to lanolin oil, lanolin wax, lanolin alcohols, lanolin fatty acids, isopropyl lanolate, cetylated lanolin, acetylated lanolin alcohols, lanolin alcohol linoleate, lanolin alcohol riconoleate; ethoxylated lanolin.

More preferred hydrophobic emollients are petrolatum; blends of petrolatum and mineral oil wherein the ratio petrolatum:mineral oil ranks from 90:10 to 50:50, and preferably is 70:30; vegetable oils and vegetable waxes such as castor oil, and carnauba wax; blends of petrolatum and vegetable oils such as castor oil; oily sugar derivatives such as the ones taught in WO 98/16538 which are cyclic polyol derivatives or reduced saccharide derivatives resulting from 35% to 100% of the hydroxyl, group of the cyclic polyol or reduced saccharide being esterified and/or etherified and in which at least two or more ester or ether groups are independently attached to a C8 to C22 alkyl or alkenyl chain, that may be linear or branched. In the context of the present invention, the term cyclic polyol encompasses all forms of saccharides. Especially preferred are monosaccharides and disaccharides. Examples of monosaccharides include xylose, arabinose, galactose, fructose, and glucose. Example of reduced saccharide is sorbitan. Examples of disaccharides are sucrose, lactose, maltose and cellobiose. Sucrose is especially preferred. Particularly preferred are sucrose esters with 4 or more ester groups. These are commercially available under the trade name Sefose® from Procter & Gamble Chemicals, Cincinnati Ohio.

Even more preferred hydrophobic emollients are petrolatum, mineral oil, Castor oil, natural waxes such as beeswax, carnauba, spermaceti, lanolin and lanolin derivatives such as liquid lanolin or lanolin oil sold by Croda International under the trade name of Fluilan, and lanolin derivatives such as ethoxylated lanolin sold by Croda International under the trade name of Solan E (PEG-75 lanolin). Most preferred hydrophobic emollients are petrolatum, mineral oil, Castor oil, and mixtures thereof.

The Humectant

The composition of the present invention herein may optionally further comprise one or more humectants at a level of from 0.1 wt % to 50 wt %, preferably from 1 wt % to 20 wt %, more preferably from 1% to 10%, even more preferably from 1% to 6% and most preferably from 2% to 5% by weight of the total composition.

Humectants that can be used according to this invention include those substances that exhibit an affinity for water and help enhance the absorption of water onto a substrate, preferably skin. Preferred humectants are polyols or are carboxyl containing such as glycerol, diglycerol, sorbitol, Propylene glycol, Polyethylene Glycol, Butylene glycol; and/or pidolic acid and salts thereof, and most preferred are humectants selected from the group consisting of glycerol (sourced from Procter & Gamble chemicals), sorbitol, sodium lactate, and urea, or mixtures thereof.

Cleaning Polymer

The liquid hand dishwashing composition herein may optionally further comprise one or more alkoxylated polyethyleneimine polymer. The composition may comprise from 0.01 wt % to 10 wt %, preferably from 0.01 wt % to 2 wt %, more preferably from 0.1 wt % to 1.5 wt %, even more preferable from 0.2% to 1.5% by weight of the total composition of an alkoxylated polyethyleneimine polymer as described on page 2, line 33 to page 5, line 5 and exemplified in examples 1 to 4 at pages 5 to 7 of WO2007/135645 published by The Procter & Gamble Company.

The alkoxylated polyethyleneimine polymer of the present composition has a polyethyleneimine backbone having from 400 to 10000 weight average molecular weight, preferably from 400 to 7000 weight average molecular weight, alternatively from 3000 to 7000 weight average molecular weight. The alkoxylation of the polyethyleneimine backbone includes: (1) one or two alkoxylation modifications per nitrogen atom, dependent on whether the modification occurs at a internal nitrogen atom or at an terminal nitrogen atom, in the polyethyleneimine backbone, the alkoxylation modification consisting of the replacement of a hydrogen atom on a polyalkoxylene chain having an average of about 1 to about 40 alkoxy moieties per modification, wherein the terminal alkoxy moiety of the alkoxylation modification is capped with hydrogen, a $C_1$-$C_4$ alkyl or mixtures thereof; (2) a substitution of one $C_1$-$C_4$ alkyl moiety or benzyl moiety and one or two alkoxylation modifications per nitrogen atom, dependent on whether the substitution occurs at a internal nitrogen atom or at an terminal nitrogen atom, in the polyethyleneimine backbone, the alkoxylation modification consisting of the replacement of a hydrogen atom by a polyalkoxylene chain having an average of about 1 to about 40 alkoxy moieties per modification wherein the terminal alkoxy moiety is capped with hydrogen, a $C_1$-$C_4$ alkyl or mixtures thereof; or (3) a combination thereof.

The composition may further comprise the amphiphilic graft polymers based on water soluble polyalkylene oxides (A) as a graft base and sides chains formed by polymerization of a vinyl ester component (B), said polymers having an average of ≤1 graft site per 50 alkylene oxide units and mean molar mass Mw of from 3,000 to 100,000 described in BASF patent application WO2007/138053 on pages 2 line 14 to page 10, line 34 and exemplified on pages 15-18.

Magnesium Ions

When utilized, the magnesium ions preferably are added as a hydroxide, chloride, acetate, sulphate, formate, oxide or nitrate salt to the compositions of the present invention, typically at an active level of from 0.01% to 1.5%, preferably from 0.015% to 1%, more preferably from 0.025% to 0.5%, by weight of the total composition.

Diamines

Another optional ingredient of the compositions according to the present invention is a diamine. Since the habits and practices of the users of liquid detergent compositions show considerable variation, the composition will preferably contain 0% to 15%, preferably 0.1% to 15%, preferably 0.2% to 10%, more preferably 0.25% to 6%, more preferably 0.5% to 1.5% by weight of said composition of at least one diamine.

Preferred organic diamines are those in which pK1 and pK2 are in the range of 8.0 to 11.5, preferably in the range of 8.4 to 11, even more preferably from 8.6 to 10.75. Preferred materials include 1,3-bis(methylamine)-cyclohexane (pKa=10 to 10.5), 1,3 propane diamine (pK1=10.5; pK2=8.8), 1,6 hexane diamine (pK1=11; pK2=10), 1,3 pentane diamine (DYTEK EP®) (pK1=10.5; pK2=8.9), 2-methyl 1,5 pentane diamine (DYTEK A®) (pK1=11.2; pK2=10.0). Other preferred materials include primary/primary diamines with alkylene spacers ranging from $C_4$ to $C_8$. In general, it is believed that primary diamines are preferred over secondary and tertiary diamines. pKa is used herein in the same manner as is commonly known to people skilled in the art of chemistry: in an all-aqueous solution at 25° C. and for an ionic strength between 0.1 to 0.5 M. Values referenced herein can be obtained from literature, such as from "Critical Stability Constants: Volume 2, Amines" by Smith and Martel, Plenum Press, NY and London, 1975.

Carboxylic Acid

The liquid detergent compositions according to the present invention may comprise a linear or cyclic carboxylic acid or salt thereof to improve the rinse feel of the composition. The presence of anionic surfactants, especially when present in higher amounts in the region of 15-35% by weight of the total composition, results in the composition imparting a slippery feel to the hands of the user and the dishware.

Carboxylic acids useful herein include $C_{1-6}$ linear or at least 3 carbon containing cyclic acids. The linear or cyclic carbon-containing chain of the carboxylic acid or salt thereof may be substituted with a substituent group selected from the group consisting of hydroxyl, ester, ether, aliphatic groups having from 1 to 6, more preferably 1 to 4 carbon atoms, and mixtures thereof.

Preferred carboxylic acids are those selected from the group consisting of salicylic acid, maleic acid, acetyl salicylic acid, 3 methyl salicylic acid, 4 hydroxy isophthalic acid, dihydroxyfumaric acid, 1,2,4 benzene tricarboxylic acid, pentanoic acid and salts thereof, citric acid and salts thereof, and mixtures thereof. Where the carboxylic acid exists in the salt form, the cation of the salt is preferably selected from alkali metal, alkaline earth metal, monoethanolamine, diethanolamine or triethanolamine and mixtures thereof.

The carboxylic acid or salt thereof, when present, is preferably present at the level of from 0.1% to 5%, more preferably from 0.2% to 1% and most preferably from 0.25% to 0.5% by weight of the total composition.

The Chelant

The composition of the present invention comprises a chelant at a level, of from 0.1% to 20%, preferably from 0.2% to 5%, more preferably from 0.2% to 3% by weight of total composition.

Suitable chelating agents can be selected from the group consisting of amino carboxylates, amino phosphonates, polyfunctionally-substituted aromatic chelating agents and mixtures thereof. Preferred chelants for use herein are the amino acids based chelants and preferably glutamic-N,N-diacetic acid (GLDA), methyl-glycine-diacetic acid (MGDA) and derivatives and/or Phosphonate based chelants and preferably Diethylenetriamine penta methylphosphonic acid.

Other Optional Components:

The liquid detergent compositions herein can further comprise a number of other optional ingredients suitable for use in liquid detergent compositions such as perfume, dyes, opacifiers, shine polymers, scrubbing or cleaning particles, solvents, hydrotropes, suds stabilizers/boosters, preservatives, disinfecting agents and pH buffering means.

The liquid detergent compositions of the present invention may be packed in any suitable packaging for delivering the liquid detergent composition for use. Preferably the package is a clear package made of glass or plastic.

EXAMPLES

Example A

The table below illustrates the coacervation index (average of two measurements±standard deviation) of hand dishwashing compositions described in example C/1 comprising 0.1% of the indicated cationic polymer measured at a 5% wt dilution in deionized water. Compositions 1 and 2 do not provide the required coacervation index and therefore fall out of the scope of the present invention. Compositions 3 to 7 demonstrate a coacervation index above the required 2.5% and therefore when used in a dishwashing process, do provide highly efficient skin conditioning during the hand dishwashing process while maintaining the required cleaning and sudsing properties in a very cost effective manner. Furthermore, these polymers as aqueous solutions, have the right rheological profile for easy processing.

| | Cationic Polymer | Coacervation Index |
|---|---|---|
| 1 | Cationically modified hydroxyethyl cellulose Polyquat 10 Ucare LR-400 (ex Dow) | 1.71 ± 0.25 |
| 2 | Dimethyl diallyl ammonium chloride/acrylamide copolymer Polyquat 7 Merquat 550 (ex Nalco) | 2.26 ± 0.11 |
| 3 | Guar Hydroxypropyl trimonium chloride Jaguar ® C500 (ex Rhodia) | 6.72 ± 0.42 |
| 4 | Guar Hydroxypropyl trimonium chloride N-Hance ® 3270 (ex AQUALON) | 7.01 ± 0.11 |
| 5 | Guar Hydroxypropyl trimonium chloride N-Hance ® 3215 (ex AQUALON) | 12.32 ± 0.27 |
| 6 | Cationically modified hydroxyethyl cellulose Polyquat 10 Ucare KG-30M (ex Dow) | 20.91 ± 0.96 |
| 7 | Cationically modified hydroxyethyl cellulose Polyquat 10 Ucare JR-30M (ex Dow) | 22.36 * |

* Only one data point available

Example B

The table below illustrates the coacervation index (average of two measurements±standard deviation) of hand dishwashing compositions described in example C/1 comprising 0.1% of the indicated cationic polymer measured at a 5% dilution with deionized water and at a 5% dilution with water having a water hardness of 15 gpg. The hand dishwashing compositions maintaining substantially their coaecervation index (i.e. maintenance above the preferred 6% coacervation index) when diluted with water having a hardness of 0 gpg or 15 gpg will be preferred. Indeed such compositions will provide in the method of the present invention very efficient hand care, sudsing and cleaning performance, independently of the water hardness of the geography of use. As it can be read from the table below, the compositions 3, 4 and 5 are preferred over the compositions 6 and 7.

| | Cationic Polymer | Coacervation Index: Deionized Water | Coacervation Index: 15 gpg Water |
|---|---|---|---|
| 3 | Guar Hydroxypropyl trimonium chloride Jaguar ® C500 (ex Rhodia) | 6.72 ± 0.42 | 6.98 ± 0.36 |
| 4 | Guar Hydroxypropyl trimonium chloride N-Hance ® 3270 (ex AQUALON) | 7.01 ± 0.11 | 6.97 ± 0.02 |
| 5 | Guar Hydroxypropyl trimonium chloride N-Hance ® 3215 (ex AQUALON) | 12.32 ± 0.27 | 7.95 ± 0.14 |
| 6 | Cationically modified hydroxyethyl cellulose Polyquat 10 Ucare KG-30M (ex Dow) | 20.91 ± 0.96 | 3.46 ± 0.37 |

-continued

| | Cationic Polymer | Coacervation Index: Deionized Water | Coacervation Index: 15 gpg Water |
|---|---|---|---|
| 7 | Cationically modified hydroxyethyl cellulose Polyquat 10 Ucare JR-30M (ex Dow) | 22.36 * | 3.35 ± 0.91 |

* Only one data point available

Examples C

Manual Dishwashing Liquid Compositions to be Used in the Method of the Present Invention

| | Ex. 1 | Ex. 2 | Ex. 3 | Ex. 4 |
|---|---|---|---|---|
| Alkyl $C_{12-14}$ $Ethoxy_{0.6}$ Sulfate | 18% | — | — | — |
| Alkyl $C_{10-14}$ $Ethoxy_{0.5-2.5}$ Sulfate | — | 17% | 17% | 18% |
| Coco amido propyl Betaine | — | — | 9% | 5% |
| Alkyl $C_{8-12}$ $Ethoxylate_{5-9}$ Nonionic | — | — | 1% | — |
| Dimehtyl coco alkyl Amine Oxide | 6% | 5.5% | — | 4% |
| Alkylpolyglucoside | — | — | — | 4% |
| Ethanol | — | — | 5% | 7% |
| Polypropyleneglycol | 0.65% | 0.8% | — | — |
| Citrate | 2.5% | — | — | 0.6% |
| Glutamic acid diacetic acid | — | 0.7% | — | — |
| Methylglycine diacetic acid | — | — | 0.5% | — |
| NaCl | 0.5% | 1.0% | — | 1.5% |
| sodium cumene sulfonate | — | — | 0.8% | — |
| Glycerol | — | 5% | 3% | — |
| Na-lactate | — | — | — | 5% |
| Guar hydroxypropyl trimmonium chloride N-Hance ® 3270 (Hercules-Aqualon) | 0.1% | 0.1% | 0.3% | 0.2% |
| Protease Purafect Prime ® ex Genencor | — | — | 25 ppm | — |
| Glycol distearate from Euperlan ® Cognis | 0.4 | — | 0.4 | — |
| Hydrogenated Castor Oil Thixcin ® Elementis | — | 0.1 | — | 0.1 |
| Mica (BASF Mearlin superfine) | — | 0.05 | — | 0.05 |
| Petrolatum | — | 0.3% | — | 1% |
| Minors* | Balance to 100% with water | | | |
| pH | 9 | 9 | 6 | 6 |

| | Ex. 5 | Ex. 6 | Ex. 7 | Ex. 8 |
|---|---|---|---|---|
| Linear Alkyl benzene Sulfonate | — | — | 12% | 7% |
| Alkyl $C_{10-14}$ $Ethoxy_{0.5-2.5}$ Sulfate | 9% | 25% | 11% | — |
| Paraffin Sulfonate | 20% | — | — | — |
| Coco amido propyl Betaine | 4% | 1.5% | — | — |
| Alkyl $C_{8-12}$ $Ethoxylate_{5-9}$ Nonionic | 6% | 0.4% | 0.6% | 2% |
| Dimehtyl coco alkyl Amine Oxide | — | — | 5% | 0.5% |
| Alkylpolyglucoside | — | — | — | 4% |
| Ethanol | 3% | — | 4% | — |
| Polypropyleneglycol | — | — | — | 0.5% |
| Citrate | 0.1% | 0.5% | 0.3% | 0.8% |
| NaCl | 0.3% | 0.6% | 0.2% | — |
| Sodium cumene sulfonate | — | — | 2% | — |
| sorbitol | — | 8% | 6% | — |
| urea | 5% | — | — | 3% |
| Cationically modified hydroxyethyl cellulose (Polyquaternium-10 - UCARE JR-30M ex Amerchol). | 0.05% | 0.15% | 0.2% | 0.25% |
| Protease Purafect Prime ®ex Genencor | 25 ppm | — | 65 ppm | 100 ppm |
| Glycol distearate from Euperlan ® Cognis | 0.5% | — | 0.3% | — |
| Hydrogenated Castor Oil Thixcin ® Elementis | | 0.15% | — | 0.2% |
| Mica (BASF Mearlin superfine) | — | 0.1% | — | 0.05% |
| Minors* | Balance to 100% with water | | | |
| pH | 7 | 5.5 | 7 | 6 |

| | Ex. 9 | Ex. 10 | Ex. 11 | Ex. 12 |
|---|---|---|---|---|
| Linear Alkylbenzene Sulfonate | 13% | — | — | — |
| Alkyl $C_{10-14}$ $Ethoxy_{0.5-2.5}$ Sulfate | 5% | 7% | 17% | 4% |
| Paraffin Sulfonate | — | 15% | 3% | 10% |

-continued

| | | | | |
|---|---|---|---|---|
| Coco amido propyl Betaine | — | 1% | 5% | 1% |
| Alkyl $C_{8-12}$ Ethoxylate$_{5-9}$ Nonionic | 1.5% | — | 1% | 0.5% |
| Dimehtyl coco alkyl Amine Oxide | 0.5% | 2% | 2% | 1.5% |
| Alkylpolyglucoside | — | 3% | — | — |
| Ethanol | 3% | — | 2% | 3% |
| Polypropyleneglycol | 0.5% | — | 1% | — |
| Citrate | 0.6% | 0.5% | 1.5% | — |
| NaCl | 0.5% | 0.5% | — | 1% |
| Sodium cumene sulfonate | — | — | — | — |
| glycerol | 5% | 3% | 4% | 7% |
| sorbitol | — | 1% | 3% | |
| Guar hydroxypropyl trimmonium chloride N-Hance ® 3215 (Hercules-Aqualon) | 0.1% | 0.15% | 0.2% | 0.05% |
| Protease Purafect Prime ®ex Genencor | 50 ppm | — | — | 90 ppm |
| Glycol distearate from Euperlan ® Cognis | 0.6% | — | — | — |
| Hydrogenated Castor Oil Thixcin ® Elementis | — | 0.05% | — | 0.25% |
| Mica (BASF Mearlin superfine) | — | 0.025% | — | 0.2% |
| Minors* | Balance to 100% with water | | | |
| pH | 5 | 8 | 7.5 | 7.7 |

Minors*: dyes, opacifier, perfumes, preservatives, hydrotropes, Mg-ions, diamines, processing aids, and/or stabilizers The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of manually cleaning dishware using a liquid hand dishwashing detergent composition, the method comprising:

providing a liquid hand dishwashing composition having a total weight and including from about 4% to about 40% of the total weight anionic surfactant, between 0.01% and 20% of the total weight amine oxide or betaine, a total level of surfactants by weight of between about 1.0% and about 50%, and between about 0.001 wt % to about 10 wt % a cationic polymer having an average molecular weight between about 350,000 and about 2,100,000; and a cationic charge density above or equal to about 0.45 meq/g, wherein the cationic polymer is a guar hydroxypropyl trimonium chloride and wherein said composition has a coacervation index upon dilution of at least about 6%;

diluting the detergent composition in water;

forming a coacervate of the cationic polymer and the surfactant in the water such that the coacervate is available to contact the skin of a user when the user is manually cleaning the dishware; and exposing the dishware and the user's skin to the diluted detergent composition.

2. A method according to claim 1 wherein said cationic polymer has cationic charge density of from about 0.45 to about 2.3 meq/g.

3. A method according to claim 1 wherein said cationic polymer has cationic charge density of from about 0.45 to about 1.5 meq/g.

4. A method according to claim 1 wherein said cationic polymer is present at a level from about 0.05% to about 1% by weight of said total composition.

5. A method according to claim 1 wherein said anionic surfactant is comprised at a level of from about 6% to about 32%.

6. A method according to claim 1 wherein said anionic surfactant is selected from the group consisting of alkyl sulfate, alkyl ethoxy sulfates and mixtures thereof.

7. A method according to claim 1 wherein the liquid hand dishwashing detergent composition further comprises from about 0.1% to about 20% by weight of the liquid detergent composition of a nonionic surfactant selected from the group consisting of $C_8$-$C_{22}$ aliphatic alcohols with about 1 to about 25 moles of ethylene oxide, alkylpolyglycosides, fatty acid amide surfactants, and mixtures thereof.

8. A method according to claim 1 wherein the liquid hand dishwashing detergent composition further comprises a rheology modifier selected from the group consisting of crystalline hydroxyl fatty ester, crystalline hydroxyl polysaccharide, and mixtures thereof.

9. A method according to claim 1 wherein the liquid hand dishwashing detergent composition further comprises a pearlescent agent selected from the group consisting of titanium dioxide-treated coated mica, pearlescent waxes derived from ethylene glycol fatty acid esters and mixtures thereof.

10. A method according to claim 1 wherein the liquid hand dishwashing detergent composition further comprises at least one protease.

11. A method according to claim 1 wherein the liquid hand dishwashing detergent composition further comprises at least one humectants selected from the group consisting of glycerol, sorbitol, sodium lactate, and urea, or mixtures thereof.

12. A method according to claim 1 wherein the liquid hand dishwashing detergent composition further comprises a hydrophobic emollient selected from the group consisting of hydrocarbon oils and waxes, vegetable oils, natural waxes and mixtures thereof.

* * * * *